US008737033B2

(12) United States Patent
Parker et al.

(10) Patent No.: US 8,737,033 B2
(45) Date of Patent: May 27, 2014

(54) CIRCUIT INTERRUPTER EMPLOYING NON-VOLATILE MEMORY FOR IMPROVED DIAGNOSTICS

(75) Inventors: Kevin L. Parker, Pittsburgh, PA (US); Theodore J. Miller, Oakdale, PA (US)

(73) Assignee: Eaton Corporation, Cleveland, OH (US)

( * ) Notice: Subject to any disclaimer, the term of this patent is extended or adjusted under 35 U.S.C. 154(b) by 103 days.

(21) Appl. No.: 13/608,495

(22) Filed: Sep. 10, 2012

(65) Prior Publication Data

US 2014/0071575 A1 Mar. 13, 2014

(51) Int. Cl.
*H01H 73/00* (2006.01)

(52) U.S. Cl.
USPC ..... 361/115; 361/42; 361/93.1

(58) Field of Classification Search
None
See application file for complete search history.

(56) References Cited

U.S. PATENT DOCUMENTS

| | | | | |
|---|---|---|---|---|
| 4,428,022 | A | 1/1984 | Engel et al. | |
| 4,958,252 | A | 9/1990 | Murphy | |
| 5,525,985 | A | 6/1996 | Schlotterer et al. | |
| 5,600,527 | A | 2/1997 | Engel et al. | |
| 5,890,097 | A | 3/1999 | Cox | |
| 5,910,760 | A | 6/1999 | Malingowski et al. | |
| 6,005,757 | A | 12/1999 | Shvach et al. | |
| 6,144,271 | A | 11/2000 | Mueller et al. | |
| 6,167,329 | A | 12/2000 | Engel et al. | |
| 6,175,780 | B1 | 1/2001 | Engel | |
| 6,185,508 | B1 | 2/2001 | Van Doorn et al. | |
| 6,771,170 | B2 | 8/2004 | Papallo, Jr. et al. | |
| 6,892,145 | B2 | 5/2005 | Topka et al. | |
| 7,050,913 | B2 | 5/2006 | Cox | |
| 7,532,955 | B2 | 5/2009 | Dougherty | |
| 7,633,736 | B2 | 12/2009 | Domitrovich et al. | |
| 7,747,415 | B1 * | 6/2010 | Churchill et al. | 702/187 |
| 7,996,171 | B2 | 8/2011 | Banhegyesi | |
| 8,121,801 | B2 | 2/2012 | Spanier et al. | |
| 8,160,824 | B2 | 4/2012 | Spanier et al. | |
| 8,190,381 | B2 | 5/2012 | Spanier et al. | |
| 2008/0204947 | A1 * | 8/2008 | Shea et al. | 361/3 |
| 2009/0206059 | A1 | 8/2009 | Kiko | |

FOREIGN PATENT DOCUMENTS

EP 0 193 732 A1 9/1986

OTHER PUBLICATIONS

European Patent Office, "International Search Report and Written Opinion", Nov. 6, 2013, 10 pp.
Wikipedia, "Ferroelectric RAM", http://en.wikipedia.org/wiki/Ferroelectric_RAM, Jul. 11, 2012, 5 pp.
Wikipedia, "Magnetoresistive random-access memory", http://en.wikipedia.org/wiki/MRAM, Jul. 31, 2012, 9 pp.

* cited by examiner

*Primary Examiner* — Jared Fureman
*Assistant Examiner* — Terrence Willoughby
(74) *Attorney, Agent, or Firm* — Eckert Seamans Cherin & Mellott, LLC; Kirk D. Houser

(57) ABSTRACT

A miniature circuit breaker includes separable contacts, an operating mechanism structured to open and close the separable contacts, a trip mechanism cooperating with the operating mechanism to trip open the separable contacts, a processor having a routine, a plurality of sensors sensing power circuit information operatively associated with the separable contacts, and a non-volatile memory accessible by the processor. The routine of the processor is structured to input the sensed power circuit information, determine and store trip information for each of a plurality of trip cycles in the non-volatile memory, store the sensed power circuit information in the non-volatile memory for each of a plurality of line half-cycles, and determine and store circuit breaker information in the non-volatile memory for the operating life span of the miniature circuit breaker.

25 Claims, 10 Drawing Sheets

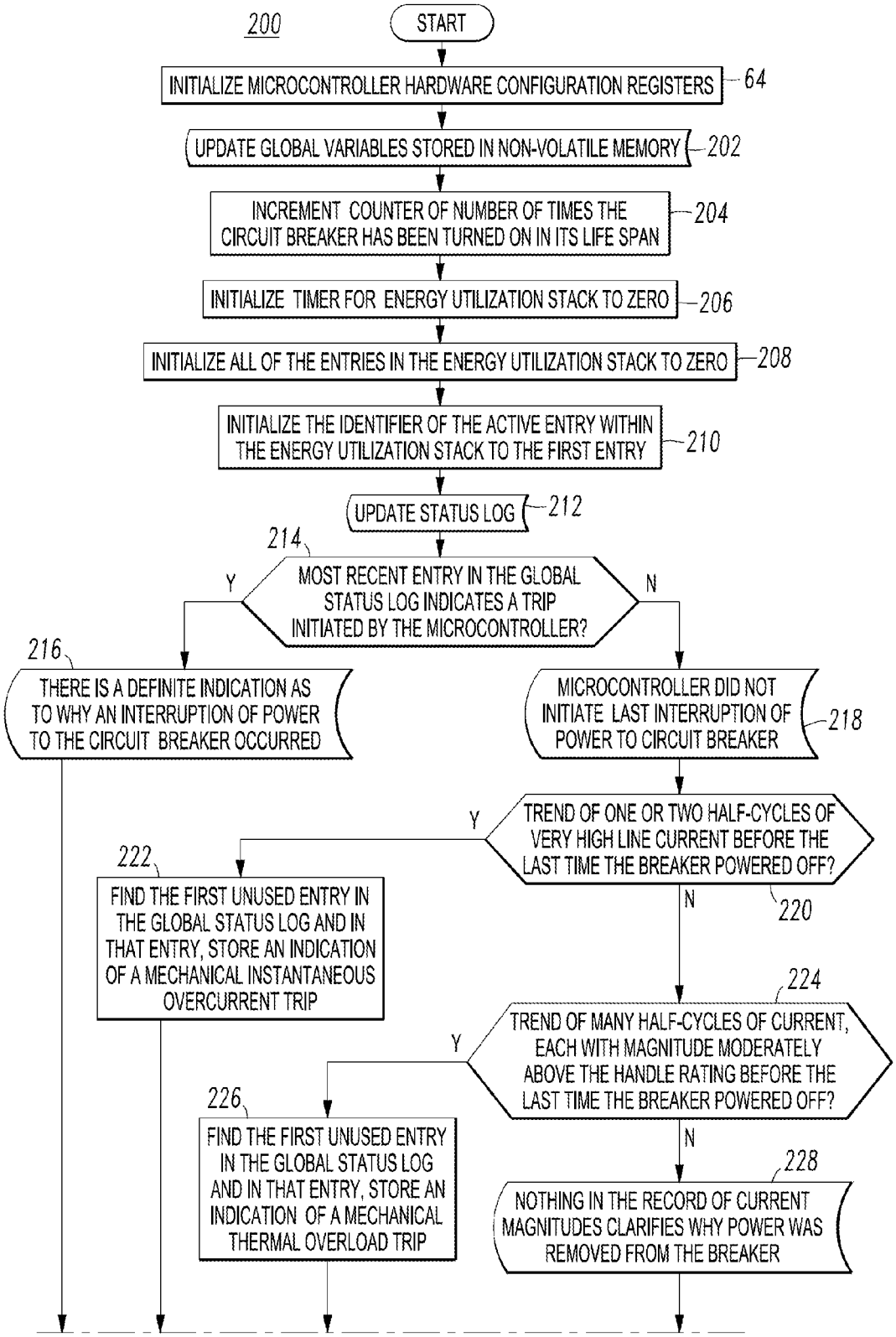
FIG. 3A1

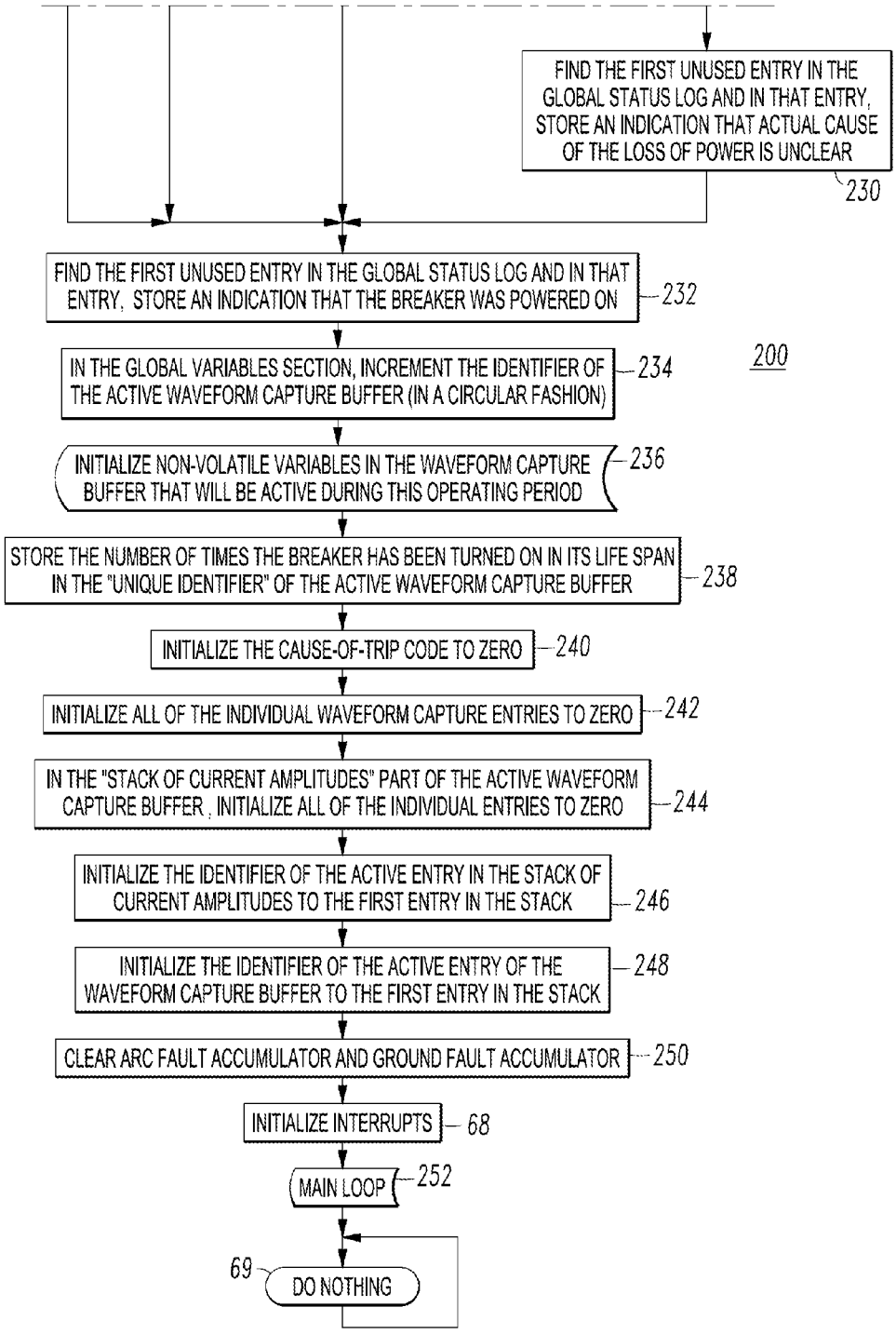
FIG. 3A2

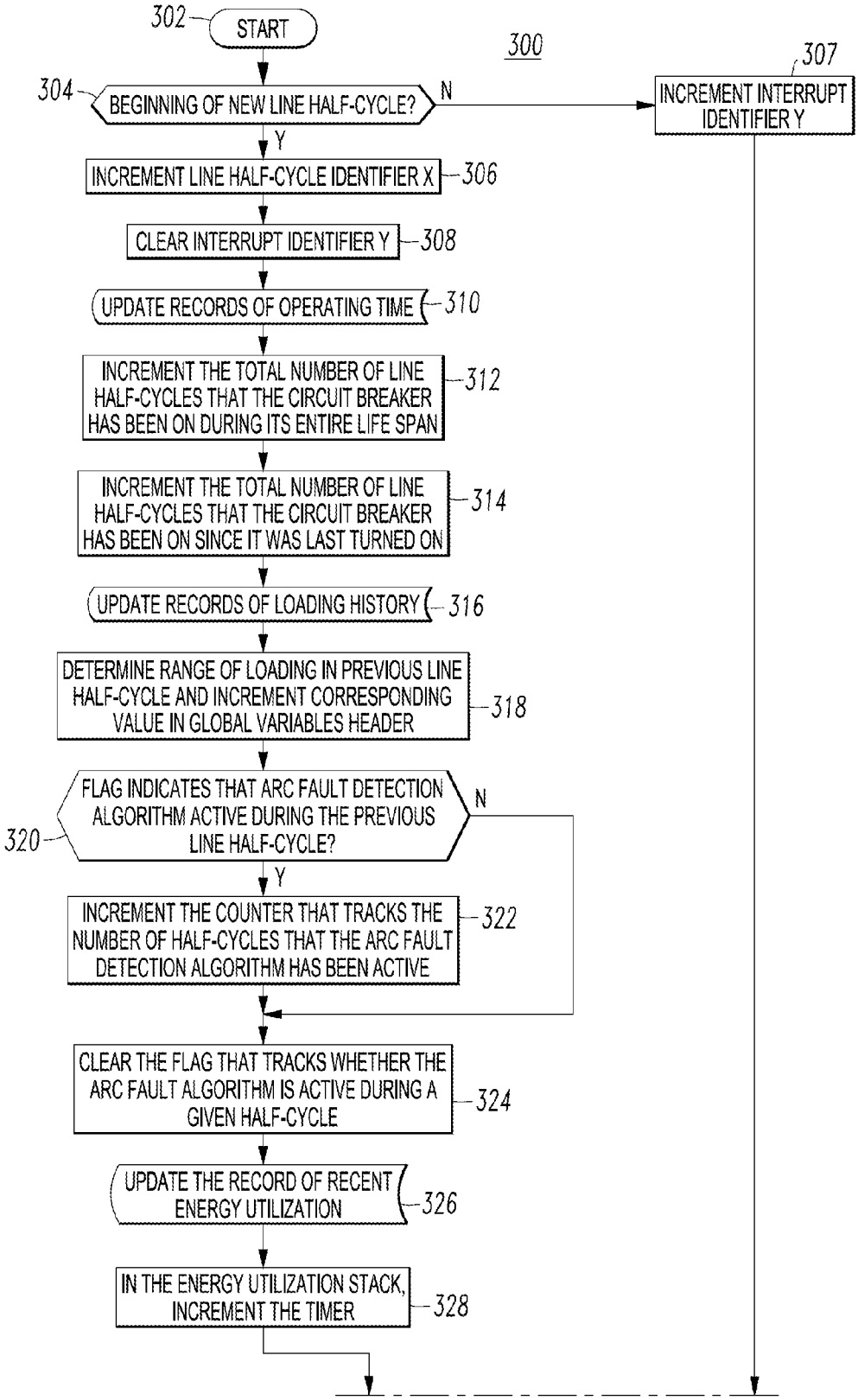
FIG. 3B1

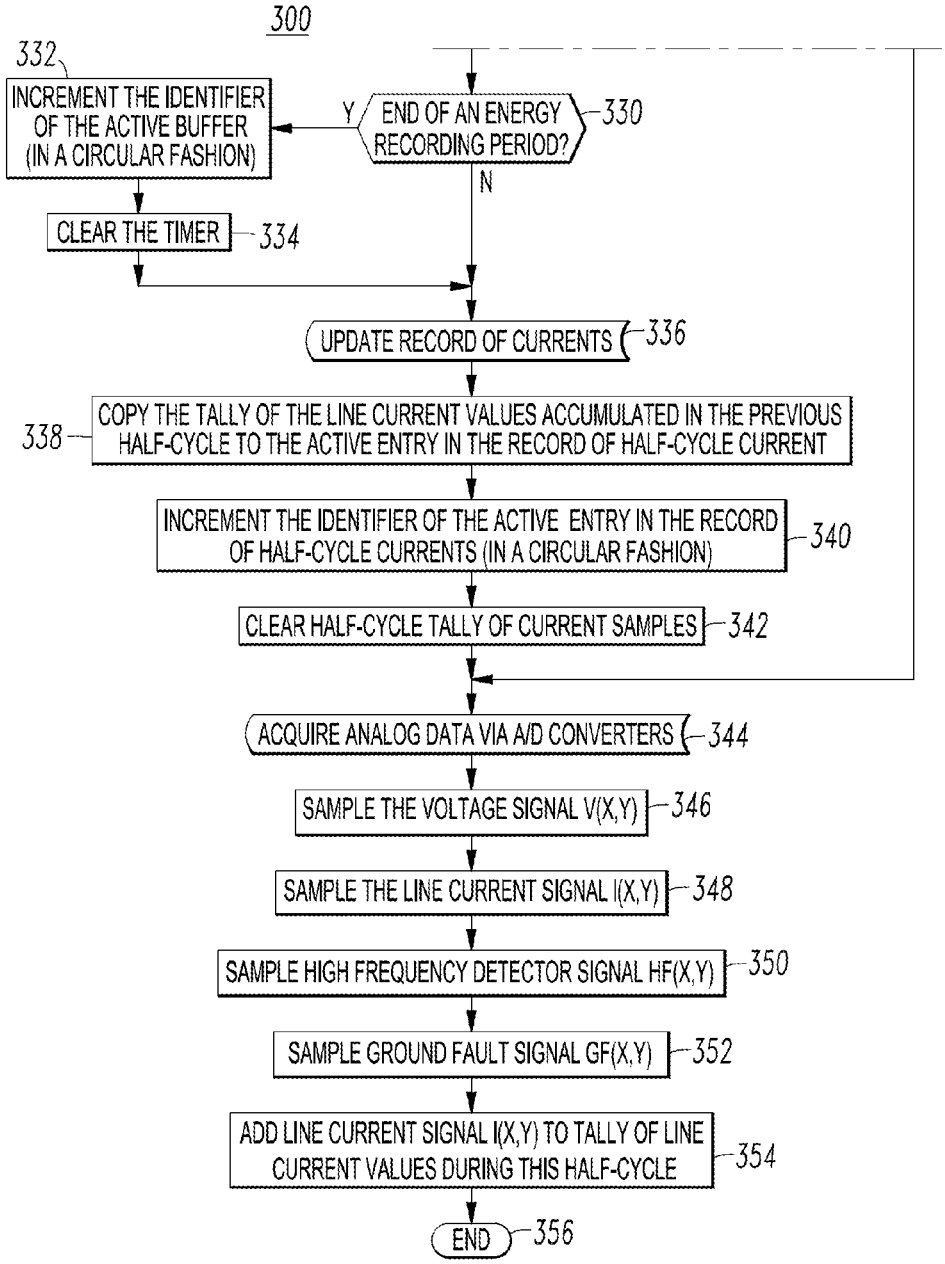
*FIG. 3B2*

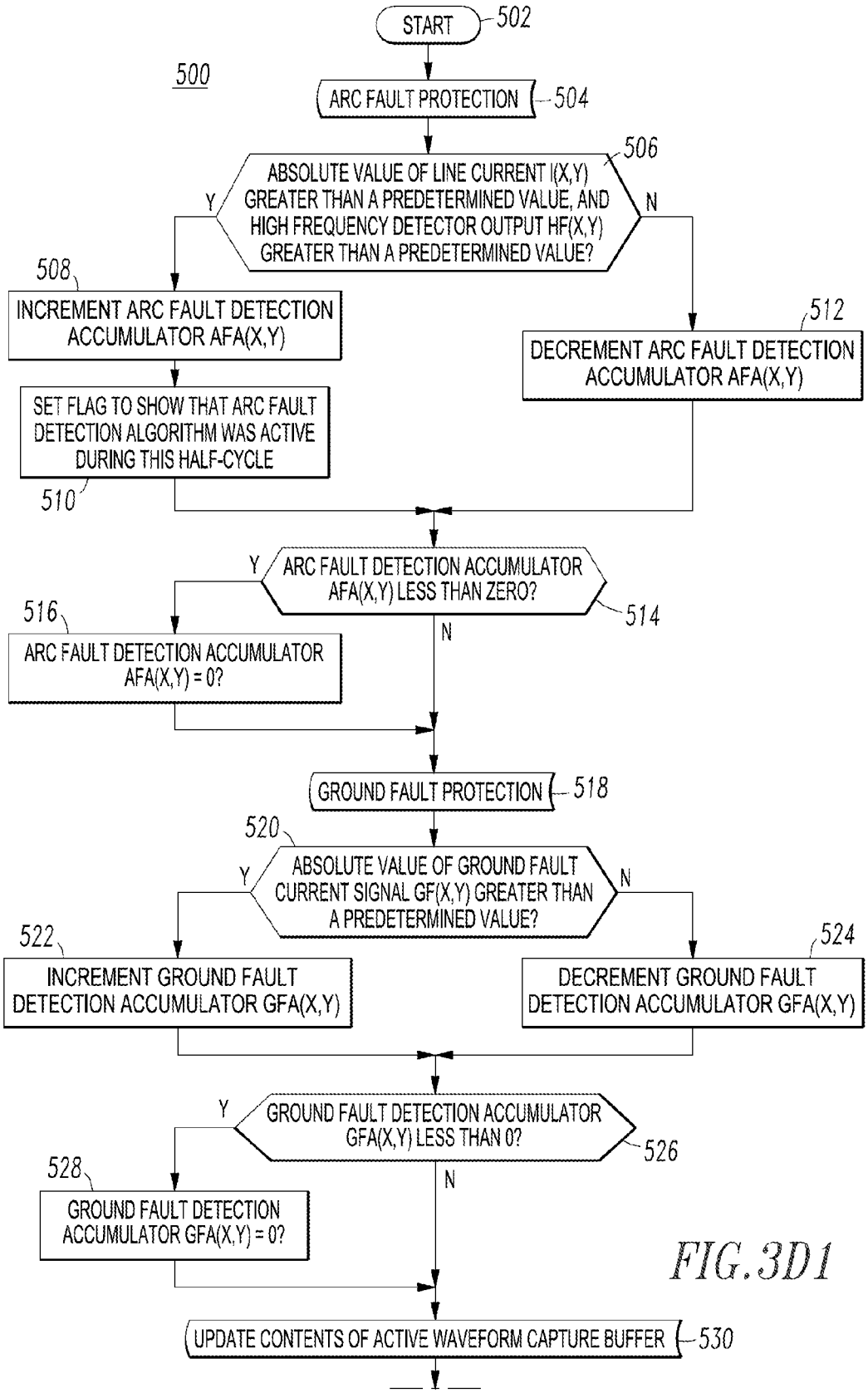
FIG. 3D1

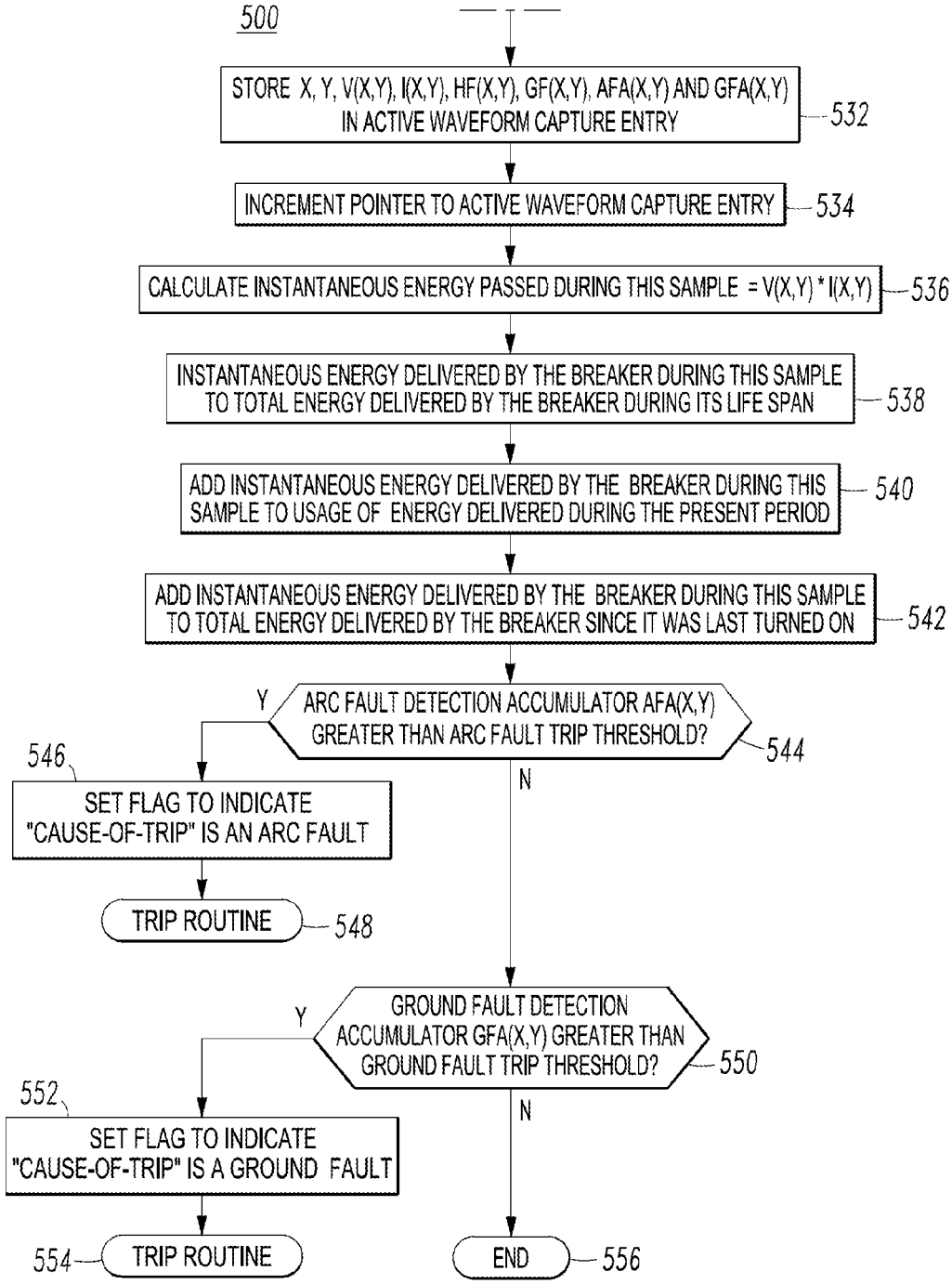
FIG. 3D2

CIRCUIT INTERRUPTER EMPLOYING NON-VOLATILE MEMORY FOR IMPROVED DIAGNOSTICS

BACKGROUND

1. Field

The disclosed concept pertains generally to circuit interrupters and, more particularly, to circuit breakers. The disclosed concept also pertains to miniature circuit breakers.

2. Background Information

Circuit interrupters, such as circuit breakers, are generally old and well known in the art. Circuit breakers are used to protect electrical circuitry from damage due to an overcurrent condition, such as an overload condition or a relatively high level short circuit or fault condition. In small circuit breakers, commonly referred to as miniature circuit breakers, used for residential and light commercial applications, such protection is typically provided by a thermal-magnetic trip device. This trip device includes a bimetal, which heats and bends in response to a persistent overcurrent condition. The bimetal, in turn, unlatches a spring powered operating mechanism, which opens the separable contacts of the circuit breaker to interrupt current flow in the protected power system.

Industrial circuit breakers often use a circuit breaker frame, which houses a trip unit. See, for example, U.S. Pat. Nos. 5,910,760; and 6,144,271. The trip unit may be modular and may be replaced, in order to alter the electrical properties of the circuit breaker.

It is well known to employ trip units which utilize a microprocessor to detect various types of overcurrent trip conditions and provide various protection functions, such as, for example, a long delay trip, a short delay trip, an instantaneous trip, and/or a ground fault trip. The long delay trip function protects the load served by the protected electrical system from overloads and/or overcurrents. The short delay trip function can be used to coordinate tripping of downstream circuit breakers in a hierarchy of circuit breakers. The instantaneous trip function protects the electrical conductors to which the circuit breaker is connected from damaging overcurrent conditions, such as short circuits. As implied, the ground fault trip function protects the electrical system from faults to ground.

The earliest electronic trip unit circuit designs utilized discrete components such as transistors, resistors and capacitors.

More recently, designs, such as disclosed in U.S. Pat. Nos. 4,428,022; and 5,525,985, have included microprocessors, which provide improved performance and flexibility. These digital systems sample the current waveforms periodically to generate a digital representation of the current. The microprocessor uses the samples to execute algorithms, which implement one or more current protection curves.

When diagnosing field issues with an arc fault circuit interrupter (AFCI), engineers often rely heavily on hearsay reports of the circumstances surrounding each issue. These reports can come from users, electricians and sales staff. Although the people providing the information are certainly well-intentioned and their efforts are greatly appreciated, the quality of information that gets reported back from the field is often of poor or questionable value. In fact, assessing the quality of information provided from field reports is often as big a challenge as determining what the original problem may have been.

When the pattern of available information is confusing or unclear, then engineers are forced to make very broad guesses as to what the field issue may have been. Hence, diagnosing a field issue is difficult with little solid information to help diagnose the issue. In these cases, it is often required to send a circuit interrupter design engineer to a field location along with oscilloscopes and other diagnostic equipment in order to collect additional firsthand information about the issue. This can be time consuming, costly and even unproductive if the field issue is not repeatable.

There is a need for a "black box" in a miniature circuit breaker, in order to improve the quantity and quality of information available when diagnosing, for example, AFCI issues encountered in the field.

In known miniature circuit breakers, the information that the circuit breaker uses to make each trip decision is lost because there is no comprehensive storage mechanism. For example, a known AFCI microprocessor stores only a single byte of information (i.e., the "cause-of-trip") in its internal data EEPROM per trip event. This is because of various restrictions.

The highest priority of an AFCI is to interrupt the protected circuit whenever an exceptional condition is suspected. The processor cannot delay circuit interruption in order to store information. Hence, the microprocessor stores a "cause-of-trip" in EEPROM only after a fault has been identified and a signal has been sent to trip open the circuit breaker operating mechanism. Also, there is a limited time after the AFCI interrupts the protected circuit for the processor to store information. This is because the AFCI uses power provided by the utility source, which is interrupted when the circuit breaker separable contacts open. For example, the time required to store information in EEPROM is relatively large (e.g., about 5 to 10 milliseconds (mS)) when compared to the power supply hold time, such that only a single byte of information can be reliably saved for each trip event.

Another problem associated with EEPROM is that the single AFCI microprocessor may stop executing code while information is being written to its EEPROM. As a consequence, the processor does not write to EEPROM any time it is looking for faults. Otherwise, if this were allowed, then the microprocessor would be "blind" to arc fault conditions each time that it stored data. Furthermore, restrictions on the number of write cycles of EEPROM (e.g., 300,000 maximum write cycles), mean that a limited amount of information can be stored in EEPROM.

A conventional branch feeder arc fault circuit breaker provides protection for parallel arcs and 30 mA ground faults. This generally does not employ a processor, and does not provide data logging, extraction of a status log or user communications. Also, no cause-of-trip information is available.

A known first generation combination circuit breaker provides protection for parallel arcs, series arcs and 30 mA ground faults. This employs a processor, provides a single trip record containing one byte of information (i.e., the most recent cause-of-trip) in data EEPROM for data logging, and provides for extraction of the cause-of-trip by connecting a third party EEPROM development tool directly to the circuit breaker printed circuit board, but does not provide user communications. The cause-of-trip information is not available to the user.

A known second generation combination circuit breaker provides improved protection for parallel arcs and series arcs, and optionally 30 mA ground faults. This employs a processor, provides several hundred trip records, each record containing one byte of information indicating a cause-of-trip for each trip event in data EEPROM for data logging, and provides for extraction of the cause-of-trip by an optional blinking LED, but only for the most recent trip event. A status log of the full trip history is available by connecting a proprietary tool directly to the circuit breaker printed circuit board, but is not available to the user.

There is room for improvement in circuit interrupters.

There is also room for improvement in circuit breakers, such as miniature circuit breakers.

SUMMARY

These needs and others are met by embodiments of the disclosed concept in which a routine of a processor of a circuit interrupter inputs sensed power circuit information, and determines and stores circuit interrupter information in a non-volatile memory for an operating life span of the circuit interrupter.

In accordance with one aspect of the disclosed concept, a miniature circuit breaker including an operating life span comprises: separable contacts; an operating mechanism structured to open and close the separable contacts; a trip mechanism cooperating with the operating mechanism to trip open the separable contacts; a processor comprising a routine; a plurality of sensors sensing power circuit information operatively associated with the separable contacts; and a non-volatile memory accessible by the processor, wherein the routine of the processor is structured to input the sensed power circuit information, determine and store trip information for each of a plurality of trip cycles in the non-volatile memory, store the sensed power circuit information in the non-volatile memory for each of a plurality of line half-cycles, and determine and store circuit breaker information in the non-volatile memory for the operating life span of the miniature circuit breaker.

As another aspect of the disclosed concept, a circuit interrupter including an operating life span comprises: separable contacts; an operating mechanism structured to open and close the separable contacts; a trip mechanism cooperating with the operating mechanism to trip open the separable contacts; a processor comprising a routine; a plurality of sensors sensing power circuit information operatively associated with the separable contacts; and a non-volatile memory accessible by the processor, wherein the routine of the processor is structured to input the sensed power circuit information, and determine and store circuit interrupter information in the non-volatile memory for the operating life span of the circuit interrupter, and wherein the circuit interrupter information is selected from the group consisting of total energy delivered through the circuit interrupter during the operating life span; total number of the line half-cycles that the separable contacts have been closed and energized during the operating life span; total number of the line half-cycles that an arc detection algorithm of the trip mechanism has been enabled during the operating life span; and total number of the line half-cycles that the circuit interrupter was loaded at a predetermined range of rated current during the operating life span.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the term "processor" shall mean a programmable analog and/or digital device that can store, retrieve, and process data; a computer; a workstation; a personal computer; a microprocessor; a microcontroller; a microcomputer; a central processing unit; a mainframe computer; a mini-computer; a server; a networked processor; or any suitable processing device or apparatus.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "operating life span" shall mean the duration of operating existence of a circuit interrupter with suitable power applied to its line terminal(s).

The disclosed concept is described in association with a single pole miniature circuit breakers, although the disclosed concept is applicable to a wide range of circuit interrupters having any number of poles.

Figure 1:
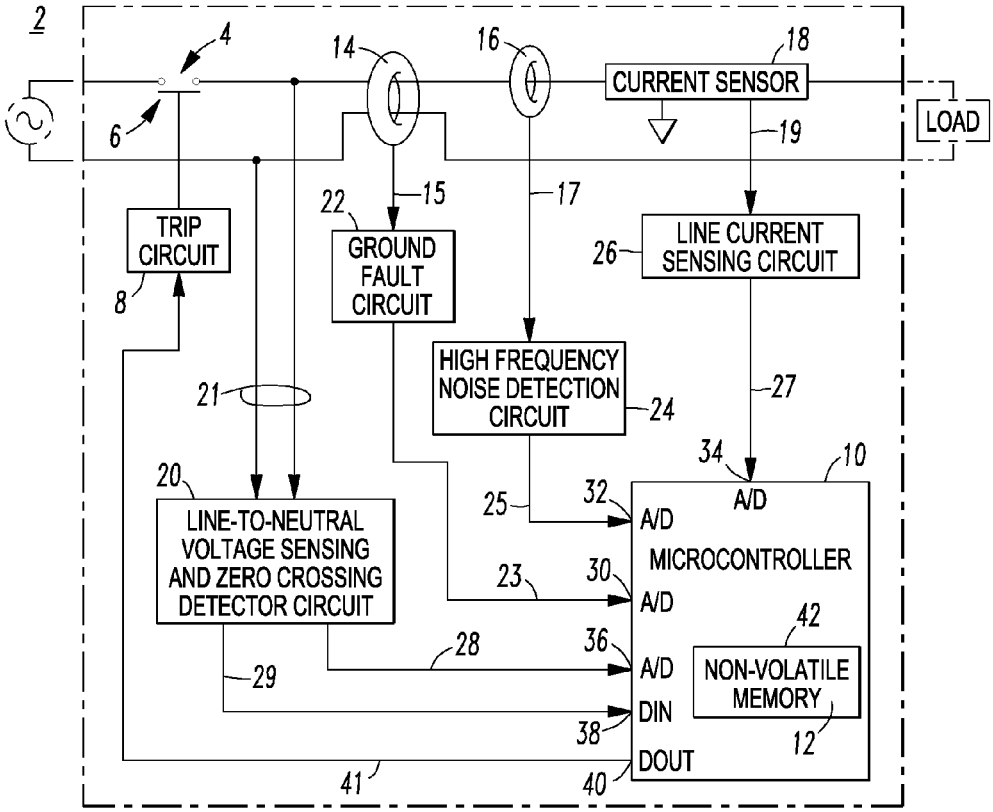
FIG. 1 is a block diagram of a miniature circuit breaker in accordance with embodiments of the disclosed concept.

Referring to FIG. 1, a circuit interrupter, such as the example miniature circuit breaker 2, is shown. The example miniature circuit breaker 2 has an operating life span and includes separable contacts 4, an operating mechanism 6 structured to open and close the separable contacts 4, a trip mechanism, such as the example trip circuit 8, cooperating with the operating mechanism 6 to trip open the separable contacts 4, and a processor, such as the example microcontroller 10, having a routine 12.

The example miniature circuit breaker 2 also includes a plurality of sensors 14,16,18,20 to sense power circuit information operatively associated with the separable contacts 4. For example and without limitation, the example sensors include the ground fault sensor 14, the broadband noise sensor 16, the current sensor 18, and a line-to-neutral voltage sensing and zero crossing detector circuit 20. The output 15 of the ground fault sensor 14 is input by a ground fault circuit 22 that outputs a ground fault signal 23 to the microcontroller 10. The output 17 of the broadband noise sensor 16 is input by a high frequency noise detection circuit 24 that outputs a high frequency detector signal 25 to the microcontroller 10. The output 19 of the current sensor 18 is input by a line current sensing circuit 26 that outputs a line current signal 27 to the microcontroller 10. The input 21 of the voltage sensing and zero crossing detector circuit 20 is a line-to-neutral voltage. In turn, the circuit 20 outputs a line voltage signal 28 and a line voltage zero crossing signal 29 to the microcontroller 10. The microcontroller 10 includes analog inputs 30,32,34,36 for the respective analog signals 23,25,27,28, and a digital input 38 for the digital line voltage zero crossing signal 29. The analog inputs 30,32,34,36 are operatively associated with a number of analog-to-digital converters (ADCs) (not shown) within the microcontroller 10. The microcontroller 10 also includes a digital output 40 that provides a trip signal 41 to the trip circuit 8.

The example miniature circuit breaker 2 further includes a non-volatile memory 42 accessible thereby. The non-volatile memory 42 may be external to (not shown) or internal to (as shown) the microcontroller 10. The routine 12 of the microcontroller 10, which may be stored by the non-volatile memory 42 (as shown) or by another suitable memory (not shown), is structured to input the sensed power circuit information from the various sensors 14,16,18,20, determine and store trip information for each of a plurality of trip cycles in the non-volatile memory 42, store the sensed power circuit information in the non-volatile memory 42 for each of a plurality of line half-cycles, and determine and store circuit breaker information in the non-volatile memory 42 for the operating life span of the miniature circuit breaker 2.

FIGS. 2A-2D show respective routines 50,60,70,90 executed by the microcontroller 10 of FIG. 1. The initialization routine 50 of FIG. 2A initializes portions of the non-volatile memory 42. At 52, the initialization routine 50 is run before the microcontroller 10 is energized in the field for the first time (e.g., during factory programming). Then, at 54, the non-volatile memory 42 is loaded with suitable initial values of trip information, sensed power circuit information and circuit breaker information.

Figure 2A:
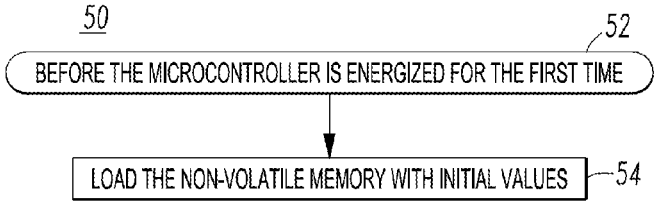
FIGS. 2A-2D are top level flowcharts of routines executed by the processor of FIG. 1.
Figure 2B:
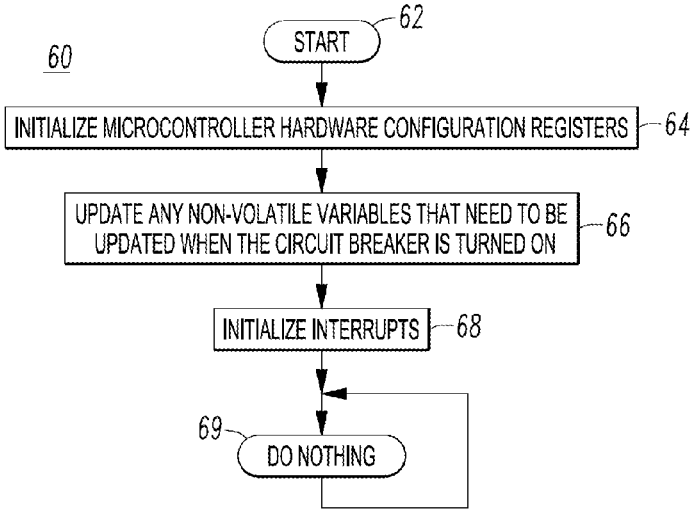

As shown in FIG. 2B, the main loop routine 60 starts at 62. Then, at 64, the microcontroller hardware configuration registers are initialized. Next, at 66, any non-volatile variables that need to be updated when the circuit breaker 2 is turned on are updated (e.g., without limitation, increment a count of the number of times that the circuit breaker has been turned on; suitable ones of the trip information, the sensed power circuit information and the circuit breaker information). Then, at 68, interrupts are initialized. Finally, at 69, nothing is done while waiting for interrupts to occur. Alternatively, a suitable background routine, such as the main loop 252 of FIG. 3A, can be executed.

Figure 2D:
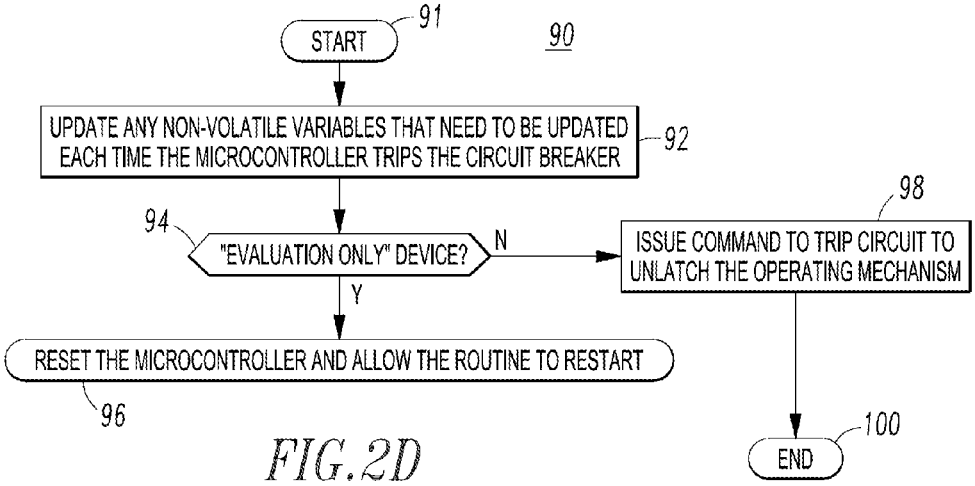
Figure 2C:
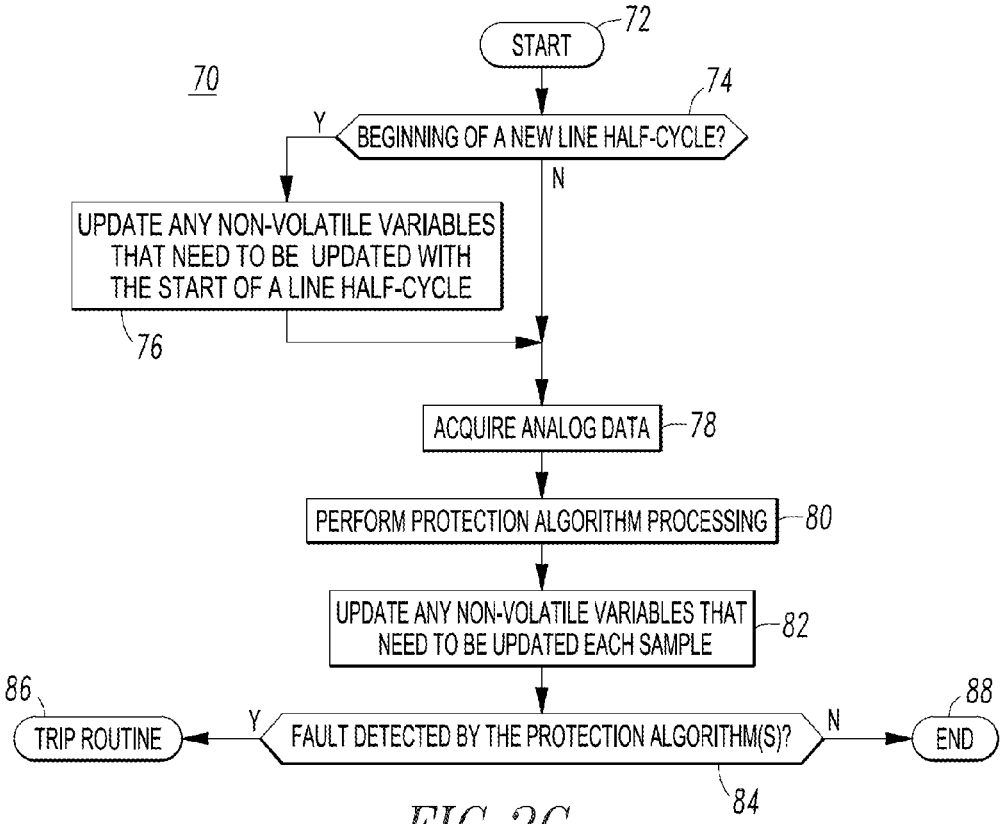

The interrupt routine 70 of FIG. 2C starts at 72. Then, at 74, it is determined if this is the beginning of a new line half-cycle based upon the state of the line voltage zero crossing signal 29 of FIG. 1. If so, then at 76, any non-volatile variables that need to be updated with the start of a line half-cycle are updated (e.g., without limitation, increment the count of the number of line half-cycles that the circuit breaker has been powered on during its entire life span). Otherwise, or after 76, analog data is acquired from the inputs 30,32,34,36 of FIG. 1. Next, at 80, suitable protection algorithm processing is performed. Then, at 82, any non-volatile variables that need to be updated each sample are updated (e.g., without limitation, store the sampled line current value in an active waveform capture buffer in the non-volatile memory 42). Next, at 84, it is determined if a fault was detected by the protection algorithm(s). If so, then at 86 the trip routine 90 of FIG. 2D is executed. Otherwise, the interrupt routine 70 ends at 88.

As shown in FIG. 2D, the trip routine 90 starts at 91. Then, at 92, any non-volatile variables that need to be updated each time the microcontroller 10 trips the circuit breaker 2 (e.g., without limitation, increment the count of the number of times the circuit breaker has been tripped by the microcontroller 10). Next, at 94, it is determined if this is an "evaluation only" device (e.g., without limitation, as defined by a predetermined location in the non-volatile memory 42). If so, then at 96, the microcontroller 10 is reset, which allows the routine 12 of FIG. 1 to restart at its beginning (e.g., 62 of the routine 60 of FIG. 2B). Otherwise, at 98, a command (trip signal 41) is issued to the trip circuit 8 to unlatch the operating mechanism 6 of FIG. 1. Then, the trip routine 90 ends at 100.

Example 1

Figure 3C:
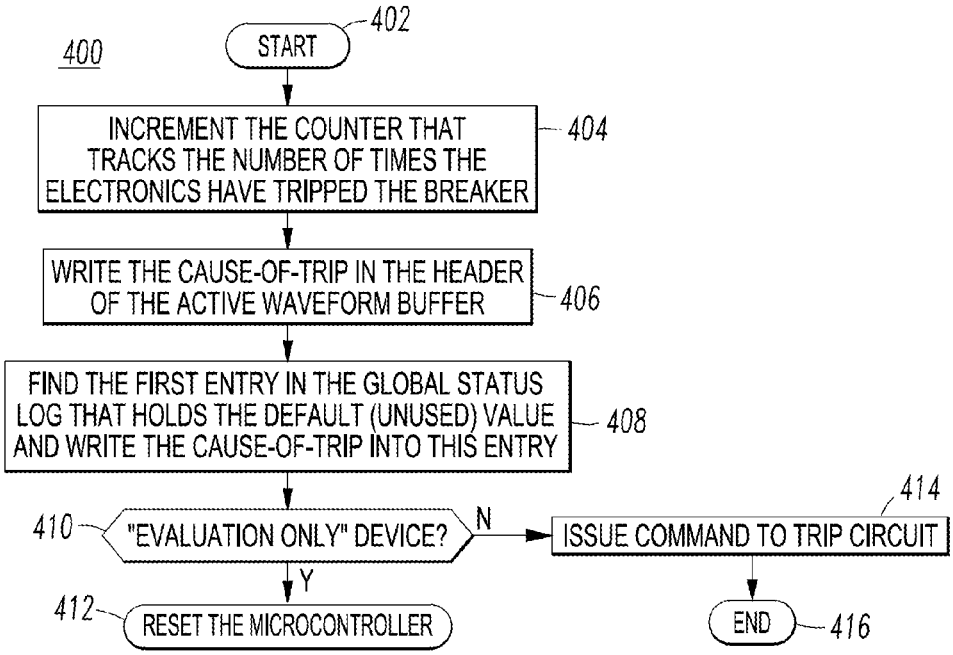
FIGS. 3A (shown as 3A1-3A2), 3B (shown as 3B1-3B2), 3C and 3D (shown as 3D1-3D2) are flowcharts of routines executed by the processor of FIG. 1.

FIGS. 3A-3D are flowcharts of routines 200,300,400,500 executed by the microcontroller 10 of FIG. 1. FIG. 3A shows the routine 200, which is a more detailed version of the main loop routine 60 of FIG. 2B. After 64, at 202, global variables stored in the non-volatile memory 42 are updated. Then, at 204, in a global variables section (612 of FIG. 5), a counter that tracks the number of times the circuit breaker 2 has been turned on in its operating life span is incremented. Next, at 206, in the global variables section, a timer for an energy utilization stack is initialized to zero. At 208, in the global variables section, all of the entries in the energy utilization stack are initialized to zero. Then, at 210, in the global variables section, the identifier of the active entry within the energy utilization stack is initialized to the first entry.

Next, at 212, a status log is updated. Then, at 214, it is determined if the most recent entry in the global status log indicates a trip initiated by the microcontroller 10. If so, then, at 216, there is a definite indication as to why an interruption of power to the circuit breaker 2 occurred and execution resumes at 232. Otherwise, at 218, the microcontroller 10 did not initiate the last interruption of power to the circuit breaker, so what caused this interruption of power is then inferred by examining the history of line current. Next, at 220, by looking at the current record in the prior active waveform capture buffer (616 of FIG. 5), it is determined if there was a trend of about one or two line half-cycles of relatively very high line current (e.g., without limitation, greater than ten times rated current) within a predetermined time (e.g., without limitation, one or two line half-cycles) before the last time the circuit breaker 2 powered off.

If so, then at 222, in the global variables section, the first unused entry in the global status log is found and in that entry, an indication is stored that a loss of power occurred that was not the result of an electronically commanded trip but may have been the result of a mechanical instantaneous overcurrent trip caused by the trip circuit 8, after which execution resumes at 232. On the other hand, at 224, from the current record in the prior active waveform capture buffer, it is determined if there was a trend of relatively many line half-cycles of current, each with magnitude moderately above the handle rating (e.g., without limitation, greater than the rated current but less about two times rated current), within a predetermined time (e.g., without limitation, 45 seconds) before the last time the circuit shut off. If so, then at 226, in the global variables section, the first unused entry in the global status log is found and in that entry, an indication is stored that a loss of power occurred that is not the result of an electronically commanded trip, but may have been the result of a mechanical thermal overload trip caused by the trip circuit 8, after which execution resumes at 232.

On the other hand, if the test at 224 failed, then at 228 nothing in the record of current magnitudes clarifies why power was removed from the circuit breaker 2. In this instance, through no failure of the circuit breaker 2 or downstream power circuit, perhaps the circuit breaker was turned off by a user (e.g., the operating mechanism 6 opened the separable contacts 4 independent of the trip circuit 8) or the utility power was lost. Next, at 230, in the global variables section, the first unused entry in the global status log is found and in that entry, an indication is stored that a loss of incoming line power occurred that is not the result of an electronically commanded trip but the actual cause of the loss of power is unclear.

After 230, at 232, in the global variables section, the first unused entry in the global status log is found and in that entry, an indication is stored that the circuit breaker 2 was powered on. Here, the purpose is that if the microcontroller 10 powers on and notes that the previous entry in the status log is also a "power on", that means an intervening loss of power occurred. If this is the case, then the microcontroller 10 tries to determine whether the intervening loss of power was due to a mechanical trip. Next, at 234, now that any previous loss of power has been analyzed, in the global variables section, the identifier of the active waveform capture buffer is incremented (in a circular fashion).

Then, at 236, the non-volatile variables in the waveform capture buffer are initialized that will be active during this operating period. Next, at 238, in the active waveform capture buffer header, the number of times the circuit breaker 2 has been turned on in its operating life span is stored in the "unique identifier" of the active waveform capture buffer. At 240, in the active waveform capture buffer header, the cause-of-trip code is initialized to zero. At 242, in the active waveform capture buffer, all of the individual waveform capture entries are initialized to zero. Then, at 244, in the "stack of current amplitudes" part of the active waveform capture buffer, all of the individual entries are initialized to zero. At 246, in the active waveform capture buffer header, the identifier of the active entry in the stack of current amplitudes is initialized to the first entry in the stack. Next, at 248, in the active waveform capture buffer header, the identifier of the active entry of the waveform capture buffer is initialized to the first entry in the stack.

At 250, RAM variables are cleared including the arc fault accumulator (AFA) and the ground fault accumulator (GFA). Finally, after interrupts are initialized at 68, the main loop is executed at 252.

FIG. 3B shows the interrupt routine 300, which is a more detailed version of the interrupt routine 70 of FIG. 2C and which starts at 302. Then, at 304, it is determined if this is the beginning of a new line half-cycle. If so, then at 306, a line half-cycle identifier x (referred to as "N" in Example 14, below) is incremented. Next, at 308, an interrupt identifier y (referred to as "S" in Example 14, below) is cleared. At 310, records of operating time are updated. Next, at 312, in the global variables header, the total number of line half-cycles that the circuit breaker 2 has been on (e.g., separable contacts 4 closed and energized) during its entire life span is incremented. Then, at 314, in the header of the active waveform capture buffer, the total number of line half-cycles that the circuit breaker 2 has been on since it was last turned on is incremented. Next, at 316, records of loading history are updated. At 318, based on the tally of the line current values accumulated during the previous line half-cycle, it is determined whether the circuit breaker 2 was loaded at a particular percentage range of rated current during the previous line half-cycle. Based upon this determination, a corresponding value in the global variables header is incremented for the total number of line half-cycles that the circuit breaker 2 has been loaded at that corresponding range during its entire operating life span.

Next, at 320, it is determined if a flag (set at 510 of FIG. 3D) indicates that an arc fault detection algorithm was active during the previous line half-cycle. If so, then at 322, in the global variables section, a counter that tracks the number of line half-cycles that the arc fault detection algorithm has been active is incremented. Otherwise, or after 322, at 324, the flag that tracks whether the arc fault detection algorithm is active during a given half-cycle is cleared.

Next, at 326, the record of recent energy utilization is updated. At 328, in the energy utilization stack (stored in the global variables section), the timer which marks the limits of a period of accumulating energy utilization is incremented. Then, at 330, it is determined if the energy utilization stack timer indicates that this is the end of an energy recording period. If so, at 332, in the energy utilization stack portion of the global variables, the identifier of the active buffer is incremented (in a circular buffer fashion). Next, at 334, in the energy utilization stack portion of the global variables, the timer is cleared.

Next, or if the test failed at 330, the record of currents is updated at 336. At 338, in the active waveform capture buffer, the tally of the line current values accumulated in the previous line half-cycle is copied to the active entry in the record of line half-cycle current. Then, at 340, in the active waveform capture buffer, the identifier of the active entry in the record of line half-cycle currents is incremented (in a circular fashion). Next, at 342, the line half-cycle tally of current samples is cleared, in order that it will be ready to receive new information in the upcoming line half-cycle.

Then, at 344, analog data is acquired using the ADCs of the microcontroller 10. Steps 346, 348, 350 and 352 respectively sample the line voltage signal v(x,y), the line current signal i(x,y), the high frequency detector signal HF(x,y) and the ground fault signal GF(x,y). Next, at 354, the line current signal i(x,y) is added to a tally of line current values during this line half-cycle. Finally, the interrupt routine 300 ends at 356. However, for arc fault and/or ground fault protection, execution continues to the arc fault/ground fault protection routine 500 of FIG. 3D.

Otherwise, if the test failed at 304, then at 307, the interrupt identifier y is incremented before execution resumes at 344.

FIG. 3C shows the trip routine 400, which is a more detailed version of the trip routine 90 of FIG. 2D and which starts at 402. Next, at 404, in the microcontroller 10 has tripped the circuit breaker is incremented. Then, at 406, in the header of the active waveform buffer, the cause-of-trip is written. Next, at 408, in the global variables section, the first entry in the global status log is found that holds the default (unused) value. The cause-of-trip code is written into this entry. If the global status log is completely full, then the trip code is written in the last location.

Next, at 410, it is determined if this is an "evaluation only" device. If so, then at 412, the microcontroller 10 is reset, which allows the routine 200 of FIG. 3A to restart at 64. On the other hand, if this is not an "evaluation only" device, then, at 414, a command (trip signal 41) is issued to the trip circuit 8 to unlatch the operating mechanism 6, after which the trip routine 400 ends at 416.

FIG. 500 shows an optional arc fault/ground fault protection routine 500, which starts at 502 after 356 of FIG. 3B and performs arc fault protection algorithm processing at 504. At 506, it is determined if the absolute value of the line current i(x,y) is greater than a predetermined value, and if the high frequency detector output HF(x,y) is greater than a predetermined value. If so, then at 508, the arc fault detection accumulator AFA(x,y) is incremented. Next, at 510, a flag is set to show that the arc fault detection algorithm was active during this line half-cycle. Otherwise, if the test failed at 506, then the arc fault detection accumulator AFA(x,y) is decremented at 512.

Next, or after 510, at 514, it is determined if the arc fault detection accumulator AFA(x,y) is less than zero. If so, then the arc fault detection accumulator AFA(x,y) is set to zero at 516.

Next, or if the test failed at 514, ground fault protection algorithm processing is performed. At 520, it is determined if the absolute value of the ground fault current signal GF(x,y) is greater than a predetermined value. If so, then at 522, the ground fault detection accumulator GFA(x,y) is incremented. On the other hand, if the test failed at 520, at 524, the ground fault detection accumulator GFA(x,y) is decremented. After 522 or 524, at 526, it is determined if the ground fault detection accumulator GFA(x,y) is less than zero. If so, then at 528, the ground fault detection accumulator GFA(x,y) is set to zero. Next, or if the test failed at 526, at 530, the contents of the active waveform capture are updated.

At 532, in the active waveform capture buffer, x, y, v(x,y), i(x,y), HF(x,y), GF(x,y), AFA(x,y) and GFA(x,y) are stored in the active waveform capture entry. Although this example action is performed in conjunction with arc fault and/or ground fault algorithms, it will be appreciated that a circuit interrupter that does not perform arc fault or ground fault detection can still store and employ a trend of current information to identify whether a mechanism tripped due to, for example, either thermal overload or instantaneous overcurrent conditions. Next, at 534, in the header of the active waveform capture buffer, the pointer to the active waveform capture entry is incremented (in a circular fashion). Then, at 536, the instantaneous energy passed by the circuit breaker 2 during this sample is calculated from v(x,y)*i(x,y). Next, at 538, in the global variables section, the instantaneous energy delivered by the circuit breaker 2 during this sample is added to the total energy delivered by the circuit breaker 2 during its operating life span. Then, at 540, in the energy usage stack portion of the global variables section, the instantaneous energy delivered by the circuit breaker 2 during this sample is added to the usage of energy delivered during the present period. Next, at 542, in the active waveform capture buffer, the instantaneous energy delivered by the circuit breaker 2 during this sample is added to the total energy delivered by the circuit breaker 2 since it was last turned on.

Then, at 544, it is determined if the arc fault detection accumulator AFA(x,y) is greater than the arc fault trip threshold. If so, then at 546, a flag is set to indicate to the trip routine 400 of FIG. 3C that the cause-of-trip is an arc fault. Finally, at 548, the trip routine 400 is executed.

Otherwise, if the test failed at 544, then at 550 it is determined if the ground fault detection accumulator GFA(x,y) is greater than the ground fault trip threshold. If so, then at 552, a flag is set to indicate to the trip routine 400 of FIG. 3C that the cause-of-trip is a ground fault and at 554 the trip routine 400 is executed. Finally, if at 550 it is determined that the ground fault detection accumulator GFA(x,y) is equal to or less than the ground fault trip threshold, then at 556, the end of interrupt routine 500 is encountered and program execution returns to the main loop 252,69 of FIG. 3A.

Example 2

The example microcontroller 10, which can perform AFCI functions, stores information continuously, without hindering circuit protection, and also stores a relatively large quantity of information about each trip decision. This information, as stored by the microcontroller 10, constitutes information from a known source and of a known quality, which is useful for diagnosing field issues.

Example 3

The example microcontroller 10 includes the example internal non-volatile memory 42 provided by, for example and without limitation, ferroelectric random-access memory (FRAM). When compared with conventional data EEPROM non-volatile memory, FRAM has a faster write performance (e.g., $125*10^{-9}$ seconds per write versus $5*10^{-3}$ seconds per write) and a much greater maximum number of write-erase cycles ($10^{15}$ versus $10^{6}$). Using FRAM capability will not necessarily improve the protection functions of the microcontroller 10; however, it allows continuous data storage, which could lead to much more extensive diagnostics as are set forth in Examples 4-12, below.

Example 4

Maintaining a count of line half-cycles in FRAM allows measuring the duration between events. For instance, counting half-cycles allow the following to be captured: (1) the total number of line half-cycles that the circuit breaker 2 was energized during its life span; and (2) the line half-cycles from when the circuit breaker 2 was powered on to when it tripped, for each trip event.

Example 5

For a data capture application, a processor with FRAM non-volatile memory can store data continuously without regard to a write-erase cycle limit. This can capture historical data, such as for example and without limitation: (1) an "oscilloscope"-like internal function, which captures several line half-cycles of sampled analog and/or digital data (e.g., without limitation, line current; high frequency detector output; line voltage; line voltage zero crossing; ground fault signal; line half-cycle and interrupt counts, which helps capture the order in which the data occurred and also the phase information of the data relative to the utility voltage) prior to a trip; if adequate memory is available, the processor can store an "oscilloscope capture" of sampled analog data seen prior to the last several trip events; and (2) either a snapshot or a history of key processor registers and/or key algorithm variables that preceded each trip.

Example 6

The example miniature circuit breaker 2 provides improved diagnostics and logging of mechanical trips. For example, some trip functions (e.g., thermal-magnetic; instantaneous trips) are provided by mechanical mechanisms, which operate independently of, for example, AFCI electronics and provide no feedback thereto. Hence, the AFCI electronics design has no way to directly distinguish between the following events: (1) a magnetic instantaneous mechanical trip occurs; (2) a thermal mechanical trip occurs; (3) the user turns off the circuit breaker 2; and (4) the utility power goes out.

As another example, if the circuit breaker 2 stores a record of several half-cycles of line current magnitudes, then it can infer either a thermal trip (e.g., relatively many half-cycles of moderately high current) or a mechanical instantaneous trip (e.g., about one or two half-cycles of relatively very high current) and distinguish these events from a user-initiated mechanical turn-off. The inferred trip information could be stored in a trip log. If desired, it could be indicated to a user (e.g., via an LED blink pattern or another suitable communications mechanism).

As a further example, if the circuit breaker 2 infers thermal and magnetic trips fairly accurately, then perhaps other, benign events (e.g., without limitation, user turnoff; loss of utility line voltage) can be inferred by the process of elimination. However, since user turn-off and voltage outage are benign conditions, identifying them is less critical.

Example 7

Load monitoring can be provided if the circuit breaker 2 has a sense of time and captures line current and voltage information for its protective function(s). This information could also be used for monitoring and trend-logging of circuit utilization and performance. Some examples include: (1) total kilowatt-hours that were delivered through the circuit breaker 2 during its operational life span (if the total kilowatt-hours and the total operating time are known, then this can provide an estimated average loading of the circuit breaker); (2) a more detailed record of the loading of the power circuit (e.g., without limitation, over the operational life span of the circuit breaker 2, the number of line half-cycles when the circuit breaker was loaded from, for example, 0-25%, 25-50%, 50-75%, 75-100%, and over 100% of rated current); (3) a trend of kilowatt-hours for each hour over an interval of time (e.g., without limitation, kilowatt-hours consumed per hour for the last twenty-four hours); (4) power factor information (since the microcontroller 10 knows the approximate line voltage magnitude and the magnitude and phase of the current); (5) peak values of utility line voltage and line current over the life span of the circuit breaker 2; and (6) this type of load monitoring could lead to some unusual "protective" functions, such as, for example, miniature circuit breakers that trip after a fixed number of kilowatt-hours, or if the average power factor fell below a predetermined value for a predetermined period of time.

Example 8

A combination circuit breaker or receptacle provides improved protection for parallel arcs and series arcs, optional 5 or 30 mA ground fault protection, and optional "glowing contact" detection. This employs a processor, provides a wide range of trip records, each trip record consisting of many bytes (limited by available memory); also, a logging function need not be limited to cause-of-trips, and could include other performance measures. This information is stored in FRAM or another suitable type of non-volatile, random access memory. Status log extraction is provided by a suitable persistent display or by wireless communications. User communications are provided by a persistent display, by wireless communications, either to a network or a handheld device, or by optical communications. A great deal of information is stored and is available to indicate why the circuit breaker tripped, and also to analyze the condition and utilization of the protected power circuit.

Example 9

The disclosed miniature circuit breaker 2 collects a wide range of information about the protected power circuit in order to make trip decisions. For example and without limitation, such information can include line current, high frequency activity, line voltage magnitude, and phase angle.

The disclosed non-volatile memory 42 (e.g., without limitation, FRAM; magnetoresistive random-access memory (MRAM); non-volatile SRAM (nvSRAM); phase-change random-access memory (PRAM); conductive bridging RAM (CBRAM); SONOS (Silicon-Oxide-Nitride-Oxide-Silicon) memory; resistive random-access memory (RRAM)) can be employed to implement a "black box". Data stored in the "black box" can greatly improve diagnoses of issues in the field. Such "black box" functionality can also be an important step toward converting, for example, a conventional arc fault circuit breaker into a "smart" circuit breaker.

Example 10

A "smart" circuit breaker includes three components: (1) a suitable processor, such as a microprocessor or the example microcontroller 10, which performs protective functions but could also perform monitoring and logging functions with available resources that remain after the protective functions are implemented; (2) a non-volatile memory, such as 42, in order that information can be accumulated over an indefinite time period and not be lost with a power outage (e.g., when the circuit breaker trips); and (3) a communications capability, in order to convey information that has been accumulated to a user.

Example 11

The disclosed miniature circuit breaker 2 including the non-volatile memory 42 is also useful when field testing design improvements (e.g., without limitation, an improved sensing mechanism; an improved protection algorithm) where, for example, a field evaluation of the design improvement is desired, but without the possibility of exposing a field test site to unwanted tripping. This can include, for example and without limitation, field applications where unwanted tripping can lead to highly undesirable results, such as aircraft electrical systems or industrial electrical systems that supply continuous or other processes in which an unexpected loss of power results in a great expense.

This permits a prototype circuit breaker including a new, but less than fully tested, design improvement to be installed in an Alpha or Beta site. The prototype circuit breaker would be fully functional in every respect, except that the prototype would not trip as a result of, for example, an improved protection algorithm. However, the prototype circuit breaker would gather useful historical data about the improved protection algorithm and store it in the non-volatile memory 42. As a result, the historical data is gathered over a suitable extended timeframe, and is eventually extracted and used to either confirm that the new approach is working as expected, or else to identify issues and either improve or discard the new approach.

Example 12

The following global variables are initialized at the factory in the non-volatile memory 42: (1) the total number of times the circuit breaker 2 has been turned on: initialize to zero; (2) the identifier of the specific active waveform capture buffer: initialized to the first active waveform capture buffer; (3) the total energy delivered through the circuit breaker 2 during its entire operating life span: initialize to zero; (4) the total number of line half-cycles that the circuit breaker 2 has been on during its entire operating life span: initialize to zero; and (5) the total number of line half-cycles that an arc detection algorithm has been enabled: initialize to zero.

In addition, the history of circuit breaker loading is initialized for: (6) the total number of line half-cycles that the circuit breaker 2 was loaded at 0-25% of its handle rating (e.g., rated current): initialize to zero; (7) the total number of line half-cycles that the circuit breaker 2 was loaded at 25-50% of its handle rating: initialize to zero; (8) the total number of line half-cycles that the circuit breaker 2 was loaded at 50-75% of its handle rating: initialize to zero; (9) the total number of line half-cycles that the circuit breaker 2 was loaded at 75-100% of its handle rating: initialize to zero; (10) the total number of line half-cycles that the circuit breaker 2 was loaded at 100-125% of its handle rating: initialize to zero; (11) the total number of line half-cycles that the circuit breaker 2 was loaded at 125-150% of its handle rating: initialize to zero; (12) the total number of line half-cycles that the circuit breaker 2 was loaded at more than 150% of its handle rating: initialize to zero; (13) the total number of times that the trip electronics have tripped the circuit breaker 2: initialized to zero; and (14) a global status log: every value in the global status log is initialized to an initial value of zero (the default value). Furthermore, an energy utilization stack is initialized to provide: (15) a timer: initialize to zero; (16) an identifier of an active buffer: initialize to the first location; and (17) energy usage entries: initialize the entire stack to zero.

The following variables are initialized at the factory in the non-volatile memory 42 for each of the active waveform capture buffers: (1) the count of times that the circuit breaker 2 has been powered on (this is a unique identifier for waveform capture): initialize to zero; (2) the number of line half-cycles that the circuit breaker 2 has been on since the last time it was powered up: initialize to zero; (3) a cause-of-trip byte: initialize to zero; (4) the identifier of the latest location within the waveform buffer: initialized to the first location in the waveform buffer; (5) the contents of the active waveform buffer: initialize all of the entries in the stack to zero; (6) the identifier of the stack of current amplitudes: initialize to the first location in the current amplitude stack; and (7) the stack of current amplitudes: initialize the whole stack to zero.

Example 13

Figure 4:
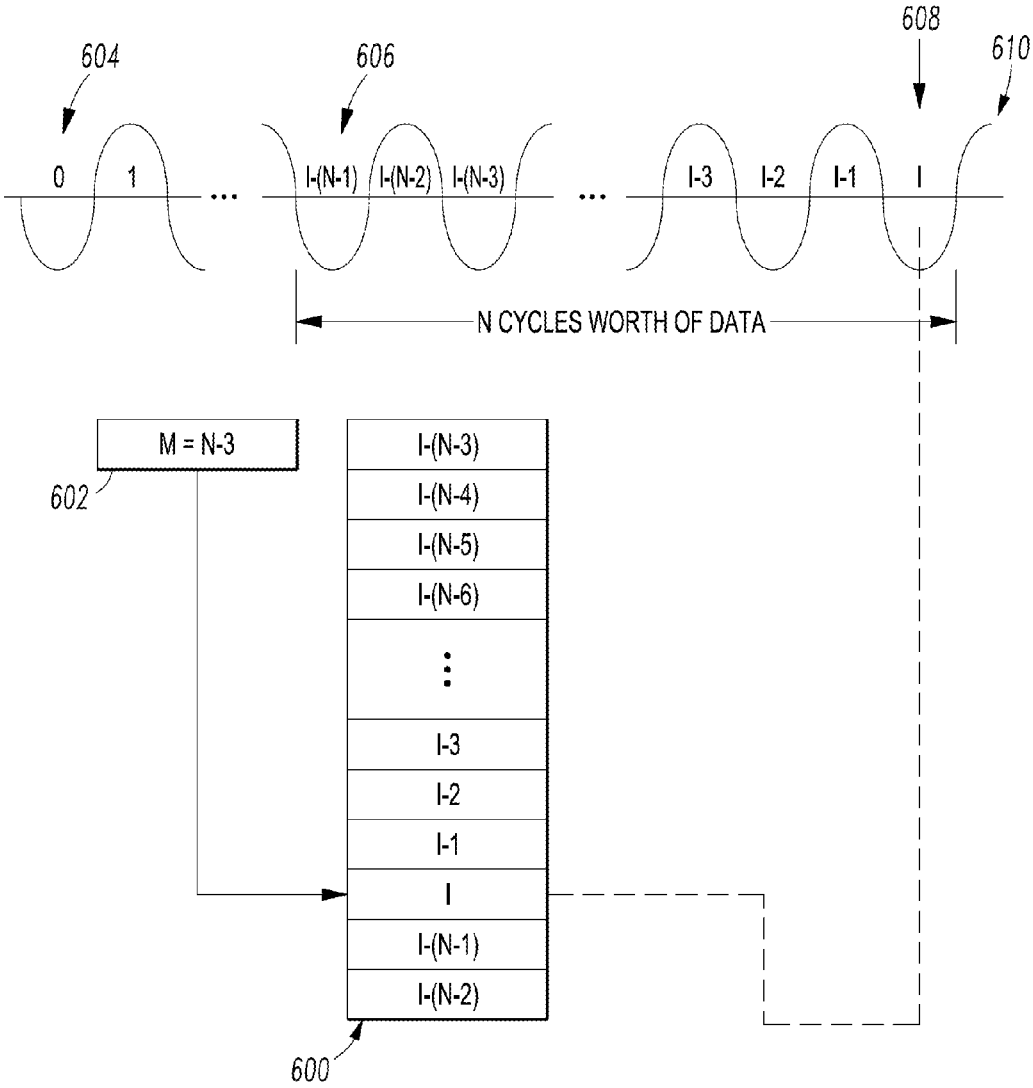
FIG. 4 is a block diagram of a circular buffer that stores one piece of data per line half-cycle for the interrupt routine of FIG. 3B.

FIG. 4 shows an example of a circular buffer 600 of length integer N that stores one piece of data per line half-cycle. The circular buffer 600 is accessed by a circular buffer pointer 602, where M=i modulo N. The address range of the circular buffer 600, relative to the first location (storing value i-(N−3) in this example), is 0 through N−1. Data for the initial line half-cycle 604 is no longer available in the circular buffer 600. The oldest line half-cycle for which data is available, data (i-(N−1)), is in line half-cycle 606. Older data is overwritten as part of the process of updating the circular buffer 600. The $i^{th}$ line half-cycle 608, the most recent line half-cycle for which complete data is available, is stored in circular buffer location N−3 in this example. Data is being collected, but is not yet stored for the present line half-cycle 610.

Example 14

Figure 5:
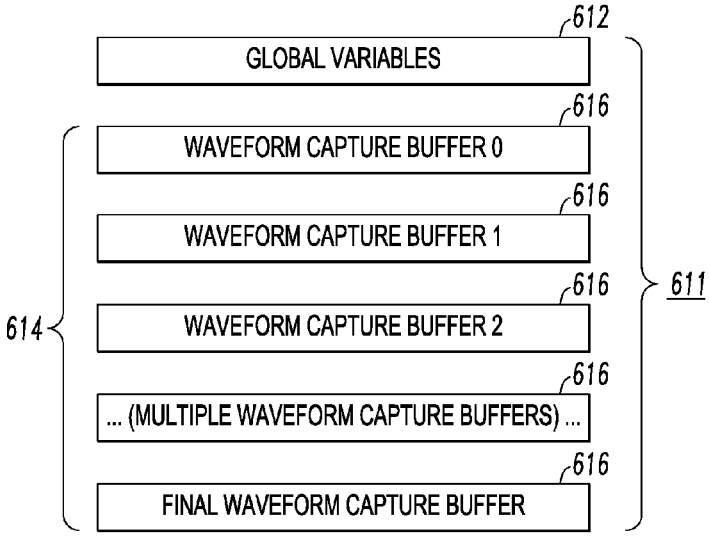
FIG. 5 is a block diagram of contents of the non-volatile memory of FIG. 1.

FIG. 5 shows example contents 611 of the non-volatile memory 42 of FIG. 1 including global variables 612 and a waveform capture stack 614, which is implemented as a circular buffer including a plurality of waveform capture buffers 616. The global variables 612 include a header having the total number of times the circuit breaker 2 has been turned on, the identifier of the specific active waveform capture buffer, the total energy delivered through the circuit breaker 2 during its entire operating life span, the total number of line half-cycles that the circuit breaker 2 has been on during its entire operating life span, the total number of line half-cycles that the series arc detection algorithm has been enabled, the total number of line half-cycles that the circuit breaker 2 was loaded at various ranges (e.g., without limitation, 0-25%, 25-50%, 50-75%, 75-100%, 100-125%, 125-150%, more than 150%) of its rated value or handle rating, and the total number of times that the microcontroller 10 has tripped the circuit breaker 2.

The global variables 612 also include a global status log having a plurality of global status log entries, with unused entries containing default values.

The global variables 612 further include an energy utilization stack having a timer (e.g., tracking a time interval over which energy is accumulated), an identifier of the active individual entry, and an energy usage stack implemented as a circular buffer having a plurality of energy usage individual entries.

Each of the waveform capture buffers 616 includes a header, a record of currents implemented as a circular buffer, and a waveform capture record implemented as a circular buffer. The header includes a count of times that the circuit breaker 2 had been powered on (this is a unique identifier for waveform capture), the number of line half-cycles that the circuit breaker 2 has been on since the last time it was powered up, the cause-of-trip byte (if a trip has occurred at the end of the time this particular waveform capture buffer was active), the identifier of (or pointer to) the active entry in the current amplitude circular buffer, and the identifier of (or pointer to) the active entry within the waveform capture buffer.

Each waveform capture entry includes plural data entries which were all sampled during a given interrupt (e.g., without limitation, N, S, v(N,S), i(N,S), HF(N,S), GF(N,S), AFA(N,S) and GFA(N,S)), where N defines the line half-cycle, S is the sample (e.g., without limitation, 8 samples per line half-cycle) within the line half-cycle, v is sampled line voltage, i is sampled line current, HF is sampled high frequency detector signal, GF is sampled ground fault signal, AFA is sampled arc fault accumulator signal (FIG. 3D), and GFA is sampled ground fault accumulator signal (FIG. 3D).

Each buffer could hold multiple entries per sample, and multiple samples. The entries could include sampled data, and/or the states of microcontroller variables or registers. Each buffer could have a preamble that stores, for example and without limitation, the location of the most recent data, and the total number of line half-cycles from when the circuit breaker 2 turned on to when it was next powered on. In this example, the zero crossing detector circuit 20 produces a square wave that is in phase with the line-to-neutral voltage. The microcontroller 10 uses the timing information in the square wave to sample synchronously with the line voltage. In this example, the microcontroller 10 samples eight times per line half-cycle, although any suitable sampling rate may be employed.

The disclosed concept of an "evaluation-only" type device permits gathering of historical data for the evaluation of new approaches, under realistic conditions and for extended durations, without introducing the risk of unwanted tripping.

Although separable contacts 4 are disclosed, suitable solid state separable contacts can be employed. For example, the disclosed miniature circuit breaker 2 includes a suitable circuit interrupter mechanism, such as the separable contacts 4 that are opened and closed by the operating mechanism 6, although the disclosed concept is applicable to a wide range of circuit interruption mechanisms (e.g., without limitation, solid state switches like FET or IGBT devices; contactor contacts) and/or solid state based control/protection devices (e.g., without limitation, drives; soft-starters; DC/DC converters) and/or operating mechanisms (e.g., without limitation, electrical, electro-mechanical, or mechanical mechanisms).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A miniature circuit breaker including an operating life span, said miniature circuit breaker comprising:

separable contacts;

an operating mechanism structured to open and close said separable contacts;

a trip mechanism cooperating with said operating mechanism to trip open said separable contacts;

a processor comprising a routine;

a plurality of sensors sensing power circuit information operatively associated with said separable contacts; and a non-volatile memory accessible by said processor, wherein the routine of said processor is structured to input the sensed power circuit information, determine and store trip information for each of a plurality of trip cycles in the non-volatile memory, store the sensed power circuit information in the non-volatile memory for each of a plurality of line half-cycles, and determine and store circuit breaker information in the non-volatile memory for the operating life span of said miniature circuit breaker.

2. The miniature circuit breaker of claim 1 wherein the routine of said processor is further structured to pre-load said non-volatile memory with initial values corresponding to initial states of said trip information, said sensed power circuit information and said circuit breaker information.

3. The miniature circuit breaker of claim 1 wherein the routine of said processor is further structured to update some of said trip information, said sensed power circuit information and said circuit breaker information in said non-volatile memory when said miniature circuit breaker is turned on.

4. The miniature circuit breaker of claim 3 wherein the routine of said processor is further structured to store some of said sensed power circuit information in a circular buffer in said non-volatile memory.

5. The miniature circuit breaker of claim 1 wherein the routine of said processor is further structured to increment a count in said non-volatile memory of times that said miniature circuit breaker has been turned on when said miniature circuit breaker is turned on.

6. The miniature circuit breaker of claim 1 wherein the routine of said processor is further structured, for each of a plurality of line half-cycles, to update said sensed power circuit information in said non-volatile memory.

7. The miniature circuit breaker of claim 6 wherein the routine of said processor is further structured to increment a count of the line half-cycles that said miniature circuit breaker has been powered on during the operating life span thereof.

8. The miniature circuit breaker of claim 6 wherein the routine of said processor is further structured to sense some of said sensed power circuit information for a plurality of samples for each of the line half-cycles, and to update some of said sensed power circuit information in the non-volatile memory for each of the samples.

9. A miniature circuit breaker including an operating life span, said miniature circuit breaker comprising:

separable contacts;

an operating mechanism structured to open and close said separable contacts;

a trip mechanism cooperating with said operating mechanism to trip open said separable contacts;

a processor comprising a routine;

a plurality of sensors sensing power circuit information operatively associated with said separable contacts; and a non-volatile memory accessible by said processor, wherein the routine of said processor is structured to input the sensed power circuit information, determine and store trip information for each of a plurality of trip cycles in the non-volatile memory, store the sensed power circuit information in the non-volatile memory for each of a plurality of line half-cycles, and determine and store circuit breaker information in the non-volatile memory for the operating life span of said miniature circuit breaker, wherein the routine of said processor is further structured, for each of a plurality of line half-cycles, to update said sensed power circuit information in said non-volatile memory, wherein the routine of said processor is further structured to sense some of said sensed power circuit information for a plurality of samples for each of the line half-cycles, and to update some of said sensed power circuit information in the non-volatile memory for each of the samples, wherein one of said sensed power circuit information is sensed line current flowing though said separable contacts; and wherein the routine of said processor is further structured to store the sensed line current in an active waveform capture buffer in the non-volatile memory.

10. The miniature circuit breaker of claim 9 wherein the active waveform capture buffer is a circular buffer in the non-volatile memory.

11. The miniature circuit breaker of claim 9 wherein said miniature circuit breaker has a rated value of current flowing though said separable contacts; and wherein the routine of said processor is further structured to determine which one of a plurality of different ranges of the rated value corresponds to the sensed line current and increment a count of the line half-cycles that the miniature circuit breaker has been loaded at said one of the different ranges.

12. The miniature circuit breaker of claim 6 wherein the routine of said processor comprises an arc fault detection routine having an active state and an inactive state; and wherein the routine of said processor is further structured to increment a count of a number of the line half-cycles that the arc fault detection routine has the active state.

13. The miniature circuit breaker of claim 6 wherein said sensed power circuit information comprises a line voltage applied to said separable contacts, a line current flowing through said separable contacts, a high frequency signal associated with said line voltage, and a ground fault signal being a difference between the line current and a neutral current; and wherein the routine of said processor is further structured to add the line current to a tally of line current values for each of the line half-cycles.

14. The miniature circuit breaker of claim 8 wherein the routine of said processor is further structured to determine instantaneous energy delivered by the miniature circuit breaker for each of the plurality of samples for each of the line half-cycles, and to determine and store in said non-volatile memory a number of: energy delivered by the miniature circuit breaker during a current one of the line half-cycles, total energy delivered by the miniature circuit breaker since it was last turned on, and total energy delivered by the miniature circuit breaker during the operating life span thereof.

15. The miniature circuit breaker of claim 6 wherein the routine of said processor is further structured to determine if said processor should cause said trip mechanism to trip open said separable contacts and to update some of said trip information and said circuit breaker information in said non-volatile memory.

16. The miniature circuit breaker of claim 15 wherein the routine of said processor is further structured to increment a count in said non-volatile memory of a number of times that the miniature circuit breaker has been tripped by said processor.

17. The miniature circuit breaker of claim 1 wherein the routine of said processor is further structured to determine that the miniature circuit breaker is an evaluation-only circuit breaker, and determine that said operating mechanism should not trip open said separable contacts, and should reset said processor and restart said routine at an initial state.

18. The miniature circuit breaker of claim 1 wherein the routine of said processor is further structured to determine that the miniature circuit breaker is not an evaluation-only circuit breaker, and determine that said operating mechanism should trip open said separable contacts and cause said operating mechanism to trip open said separable contacts.

19. The miniature circuit breaker of claim 1 wherein said non-volatile memory is a ferroelectric random access memory.

20. The miniature circuit breaker of claim 1 wherein one of said sensed power circuit information is sensed line current flowing though said separable contacts; and wherein the routine of said processor is further structured to determine that there was a trend of a number of line half-cycles of the sensed line current being above a predetermined value within a predetermined time before a last time that said miniature circuit breaker powered off, and store an indication in said non-volatile memory that a loss of power occurred from a mechanical instantaneous overcurrent trip caused by said trip mechanism.

21. The miniature circuit breaker of claim 1 wherein one of said sensed power circuit information is sensed line current flowing though said separable contacts; and wherein the routine of said processor is further structured to determine that there was a trend of a number of line half-cycles of the sensed line current being above a first predetermined value and below a larger second predetermined value within a predetermined time before a last time that said miniature circuit breaker powered off, and store an indication in said non-volatile memory that a loss of power occurred from a mechanical thermal overload trip caused by said trip mechanism.

22. The miniature circuit breaker of claim 1 wherein one of said sensed power circuit information is sensed line current flowing though said separable contacts; and wherein the routine of said processor is further structured to determine that there was no trend of a number of line half-cycles of the sensed line current being above a first predetermined value and below a larger second predetermined value within a predetermined time before a last time that said miniature circuit breaker powered off, and store an indication in said non-volatile memory that a loss of power occurred from a loss of incoming line power or from said operating mechanism opening said separable contacts independent of said trip mechanism.

23. The miniature circuit breaker of claim 1 wherein said circuit breaker information is selected from the group consisting of total energy delivered through said miniature circuit breaker during the operating life span; total number of the line half-cycles that said separable contacts have been closed and energized during the operating life span; total number of the line half-cycles that an arc detection algorithm of said trip mechanism has been enabled during the operating life span; total number of the line half-cycles that said miniature circuit breaker was loaded at a predetermined range of rated current during the operating life span; and total number of times that said processor has tripped said miniature circuit breaker during the operating life span.

24. A circuit interrupter including an operating life span, said circuit interrupter comprising:

separable contacts;

an operating mechanism structured to open and close said separable contacts;

a trip mechanism cooperating with said operating mechanism to trip open said separable contacts;

a processor comprising a routine;

a plurality of sensors sensing power circuit information operatively associated with said separable contacts; and a non-volatile memory accessible by said processor, wherein the routine of said processor is structured to input the sensed power circuit information, and determine and store circuit interrupter information in the non-volatile memory for the operating life span of said circuit interrupter, and wherein said circuit interrupter information is selected from the group consisting of total energy delivered through said circuit interrupter during the operating life span;

total number of the line half-cycles that said separable contacts have been closed and energized during the operating life span; total number of the line half-cycles that an arc detection algorithm of said trip mechanism has been enabled during the operating life span; and total number of the line half-cycles that said circuit interrupter was loaded at a predetermined range of rated current during the operating life span.

25. The circuit interrupter of claim 24 wherein the routine of said processor is further structured to determine that the circuit interrupter is an evaluation-only circuit interrupter, and determine that said operating mechanism should not trip open said separable contacts, and should reset said processor and restart said routine at an initial state.

* * * * *